US007915978B2

(12) United States Patent
Zhang et al.

(10) Patent No.: US 7,915,978 B2
(45) Date of Patent: Mar. 29, 2011

(54) COMPACT TUNABLE DUAL BAND STOP FILTER

(75) Inventors: Yunchi Zhang, Meriden, CT (US); Michael Joseph Adkins, Fruitland, MD (US)

(73) Assignee: Radio Frequency Systems, Inc., Meridan, CT (US)

( * ) Notice: Subject to any disclaimer, the term of this patent is extended or adjusted under 35 U.S.C. 154(b) by 256 days.

(21) Appl. No.: 12/362,195

(22) Filed: Jan. 29, 2009

(65) Prior Publication Data

US 2010/0188174 A1 Jul. 29, 2010

(51) Int. Cl.
*H01P 1/20* (2006.01)

(52) U.S. Cl. ..... 333/203; 333/202

(58) Field of Classification Search ..... 333/202, 333/203, 204, 205, 206, 207, 208, 209, 230
See application file for complete search history.

(56) References Cited

U.S. PATENT DOCUMENTS

| | | | | |
|---|---|---|---|---|
| 4,862,122 | A * | 8/1989 | Blair et al. | 333/202 |
| 5,949,309 | A * | 9/1999 | Correa | 333/202 |
| 2006/0071737 | A1 * | 4/2006 | Puoskari | 333/203 |
| 2007/0052495 | A1 * | 3/2007 | Wada | 333/134 |

* cited by examiner

*Primary Examiner* — Stephen E Jones
(74) *Attorney, Agent, or Firm* — Kramer & Amado, PC

(57) ABSTRACT

Various exemplary embodiments include a technique for tuning a filter to have two stop bands. This technique may involve combination of signals from a plurality of high-band notch resonators and low-band notch resonators. Loop wires may couple both high-band and low-band notch resonators to a central conductor, thereby enabling the central conductor to transmit a signal having dual stop bands.

20 Claims, 6 Drawing Sheets

Filter Element 200

COMPACT TUNABLE DUAL BAND STOP FILTER

TECHNICAL FIELD

Various exemplary embodiments relate generally to a tunable band stop filter and, more particularly, to a filter having two notches in its frequency response.

BACKGROUND

Many systems use filters to selectively attenuate certain signal frequencies. Band stop filters greatly reduce signal strength within a particular band of frequencies, but otherwise permit the signal to pass through the filter without attenuation. In some cases, a filter may need to have two stop bands instead of one, selectively removing these dual bands without impacting other frequencies.

Band stop filters are also known as notch filters. Other names for such filters include band limit, T-notch, band-elimination, and band-reject. Regardless of the assigned name, all of these filters block transmission of a relatively narrow band of frequencies, where the highest blocked frequency is usually no more than one hundred times the lowest blocked frequency.

Existing techniques can couple band stop filters together, but such techniques have certain drawbacks. For example, a cross-slot iris may couple two resonating cavities, transferring a magnetic field from a first cavity to a second cavity. In conventional systems, such magnetic field transfer may involve an elongated string of cavities, where the first cavity is aligned along the same axis as the second cavity.

However, it may be difficult to provide tuning when collinear cavities are coupled by an iris. Because the iris may be disposed along the central line, it may not be possible to move the cavities once they are linked together. Moreover, it may not be easy for a user to access the iris if a large number of cavities are coupled together in a string. Such a structure may be cumbersome and difficult to store.

In addition, a known technique for combining notch filters to produce a double stop bands may produce a stretched, unwieldy structure. Cascading a first notch filter into a second notch filter, according to this conventional approach, would require an elongated transmission line, stretched out along the length of both the first notch filter and the second notch filter.

Moreover, cascading notch filters together may result in a degraded signal. While the initial notch filter would theoretically only subtract a stop band from a signal, it may also produce significant distortion and noise. This is particularly true if the initial notch filter consisted of a plurality of cavity resonators, wherein each resonator might contribute a small amount of distortion or noise. Therefore, the output of the cascaded notch filters would not produce a clean signal with two stop bands but a spectrum with significant noise and distortion.

For the foregoing reasons and for further reasons that will be apparent to those of skill in the art upon reading and understanding this specification, there is a need for an improved way of tuning a filter with two stop bands. There is also a need to produce a dual stop band characteristic on a transmission line that uses a more compact configuration. Furthermore, there is a need to produce dual stop bands without using cascaded filters.

SUMMARY

In light of the present need for an improved technique for tuning a filter with two stop bands, a brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

In various exemplary embodiments, a tunable filter that provides dual stop bands may comprise a central conductor disposed along a first axis; and a plurality of filter elements that encompass the central conductor, each of the filter elements aligned along a respective axis substantially orthogonal to the first axis, each of the filter elements further comprising: a high-band notch resonator disposed on a first side of the central conductor; a low-band notch resonator disposed on a second side of the central conductor, the second side being substantially opposite to the first side; and a coupling element disposed between the high-band notch resonator and the central conductor, disposed between the low-band notch resonator and the central conductor, and soldered so that at least a portion of the coupling element is substantially orthogonal to the central conductor along the respective axis of the filter element, wherein the coupling element combines signals from the high-band notch resonator and the low-band notch resonator to produce a filtered signal that has the dual stop bands disposed symmetrically on either side of a central frequency, and wherein the coupling element has a length substantially equal to an integral multiple of a quarter wavelength of the central frequency.

In various exemplary embodiments, the central conductor may be a transmission line. Alternatively, the central conductor may be a stripline. In a further exemplary embodiment, the central conductor may be a coaxial line. In yet another exemplary embodiment, the central conductor may be a microstrip line.

In various exemplary embodiments, the coupling element may comprise a loop wire, the loop wire extending from the high-band notch resonator to the low-band notch resonator. The loop wire may extend through a first open slot in a cavity wall of the high-band notch resonator to the central conductor and extend from the central conductor through a second open slot in a cavity wall of the low-band notch resonator.

In various exemplary embodiments, a tuner for a band stop filter may comprise a coupling element that combines signals from a high-band notch resonator and a low-band notch resonator to produce a filtered signal that has dual stop bands disposed symmetrically on either side of a central frequency; and a central conductor that receives the filtered signal from the coupling element, wherein the coupling element may have a length equal to an integral multiple of a quarter wavelength of the central frequency and the coupling element is soldered to be substantially perpendicular to the central conductor.

In various exemplary embodiments, a method of tuning a signal to produce dual stop bands may comprise: using a plurality of high-band notch resonators to produce a first notch in a signal characteristic; using a plurality of low-band notch resonators to produce a second notch in the signal characteristic; using a plurality of coupling elements to combine signals from the plurality of high-band notch resonators and the plurality of low-band notch resonators to produce a filtered signal that has dual stop bands disposed symmetrically on either side of a central frequency; and sending the filtered signal from the coupling elements to a central conductor, wherein each of the coupling elements may have a length equal to an integral multiple of a quarter wavelength of the central frequency and each of the coupling elements is soldered to be substantially perpendicular to the central conductor.

BRIEF DESCRIPTION OF THE DRAWINGS

In order to better understand the various exemplary embodiments, reference is made to the accompanying drawings, wherein.

DETAILED DESCRIPTION

Figure 1:
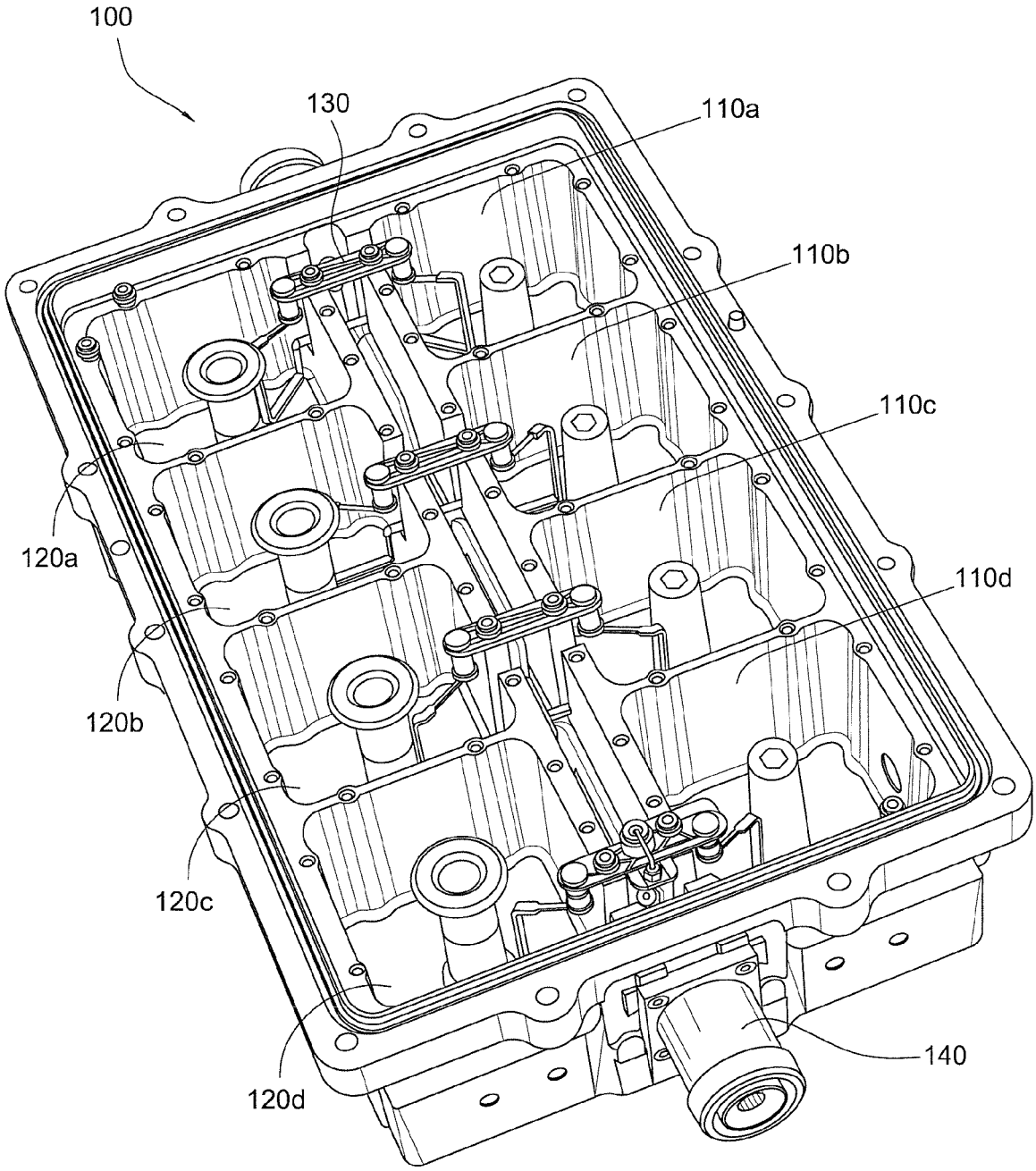
FIG. 1 is a perspective view of an exemplary tunable filter.

Referring now to the drawings, in which like numerals refer to like components or steps, there are disclosed broad aspects of various exemplary embodiments.

FIG. 1 is a perspective view of an exemplary tunable filter 100. Tunable filter 100 may comprise four high-band notch resonators 110*a*, 110*b*, 110*c*, 110*d*, four low-band notch resonators 120*a*, 120*b*, 120*c*, 120*d*, at least one coupling element 130, and a central conductor 140. These elements are described in detail below.

Tunable filter 100 may comprise a plurality of high-band notch resonators 110*a*, 110*b*, 110*c*, 110*d* disposed along a first axis. High-band resonators 110*a*, 110*b*, 110*c*, 110*d* may have metallic walls to prevent leakage of electromagnetic fields between respective cavities inside high-band resonators 110*a*, 110*b*, 110*c*, 110*d*. While four high-band resonators 110*a*, 110*b*, 110*c*, 110*d* are depicted in FIG. 1, the number of high-band resonators 110*a*, 110*b*, 110*c*, 110*d* may vary depending upon their desired application, as will be apparent to those having ordinary skill in the art.

High-band resonators 110*a*, 110*b*, 110*c*, 110*d* may be box-shaped, having rectangular cross-sections. Alternatively, high-band resonators 110*a*, 110*b*, 110*c*, 110*d* may be cylindrical, having circular cross-sections. Other implementations of high-band resonators 110*a*, 110*b*, 110*c*, 110*d*, such as a spherical configuration, may be used as will be apparent to those having ordinary skill in the art.

High-band resonators 110*a*, 110*b*, 10*c*, 10*d* may be fabricated from a metal having a high thermal conductivity. For example, as will be apparent to those having ordinary skill in the art, aluminum, a metal with a thermal conductivity value of 221 W/mK, could be used. Alternatively, a non-metallic material, such as ceramic, may be used so long as high-band resonators 110*a*, 110*b*, 110*c*, 110*d* are disposed within a housing that can evacuate heat at a sufficient rate.

The tunable filter 100 may also comprise a plurality of low-band notch resonators 120*a*, 120*b*, 120*c*, 120*d* disposed along a second axis. Unlike conventional techniques that have collinear cavities, the second axis may be separated from and parallel to the first axis in this arrangement. Low-band resonators 120*a*, 120*b*, 120*c*, 120*d* may have metallic walls to prevent leakage of electromagnetic fields between respective cavities inside low-band resonators 120*a*, 120*b*, 120*c*, 120*d*. While four low-band resonators 120*a*, 120*b*, 120*c*, 120*d* are depicted in FIG. 1, the number of low-band resonators 120*a*, 120*b*, 120*c*, 120*d* may vary depending upon their desired application, as will be apparent to those having ordinary skill in the art.

As with high-band notch resonators 110*a*, 110*b*, 110*c*, 110*d*, low-band resonators 120*a*, 120*b*, 120*c*, 120*d* may be box-shaped, having rectangular cross-sections. Alternatively, low-band resonators 120*a*, 120*b*, 120*c*, 120*d* may be cylindrical, having circular cross-sections. Other implementations of low-band resonators 120*a*, 120*b*, 120*c*, 120*d*, such as a spherical configuration, may be used as will be apparent to those having ordinary skill in the art.

Low-band resonators 120*a*, 120*b*, 120*c*, 120*d* may be fabricated from a metal having a high thermal conductivity. For example, as will be apparent to those having ordinary skill in the art, aluminum, a metal with a thermal conductivity value of 221 W/mK, could be used. Alternatively, a non-metallic material, such as ceramic, may be used so long as low-band resonators 120*a*, 120*b*, 120*c*, 120*d* are disposed within a housing that can evacuate heat at a sufficient rate.

The tunable filter 100 may further comprise a coupling element 130 that combines signals from a single high-band notch resonator 110*a* and a single low-band notch resonator 120*a* to produce a filtered signal that has a dual stop band characteristic. Coupling element 130 may be a wire made of a metal that is sufficiently malleable, ductile, and electrically conductive. As will be apparent to those of ordinary skill in the art, an inexpensive design choice for coupling element 130 may be copper. However, any suitable material may be used for coupling element 130, provided that the material is both capable of electrically coupling high-band resonator 110*a* to low-band resonator 120*a* and bendable so that the amount of coupling between high-band resonator 110*a* and low-band resonator 120*a* is easily tunable.

While only a single coupling element 130 is marked in FIG. 1, tunable filter 100 may use a plurality of coupling elements 130. In such a case, each coupling element 130 may correspond to a respective pair of high-band 110*a*, 110*b*, 110*c*, 110*d* and low-band 120*a*, 120*b*, 120*c*, 120*d* notch resonators. Each coupling element 130 may be regularly spaced to provide a more symmetric signal.

The total length of coupling element 130 may be designed to provide a desired central frequency. The central frequency may be a frequency directly between the high stop band and the low stop band. The length of coupling element 130 may be an integral multiple of one-quarter wavelength of the central frequency.

The tunable filter 100 may additionally comprise a central conductor 140 that receives the filtered signal from coupling element 130. Central conductor 140 may be a transmission line. Alternatively, central conductor 140 may be a stripline. In a further exemplary embodiment, central conductor 140 may be a coaxial line. In yet another exemplary embodiment, central conductor 140 may be a microstrip line.

Figure 2:
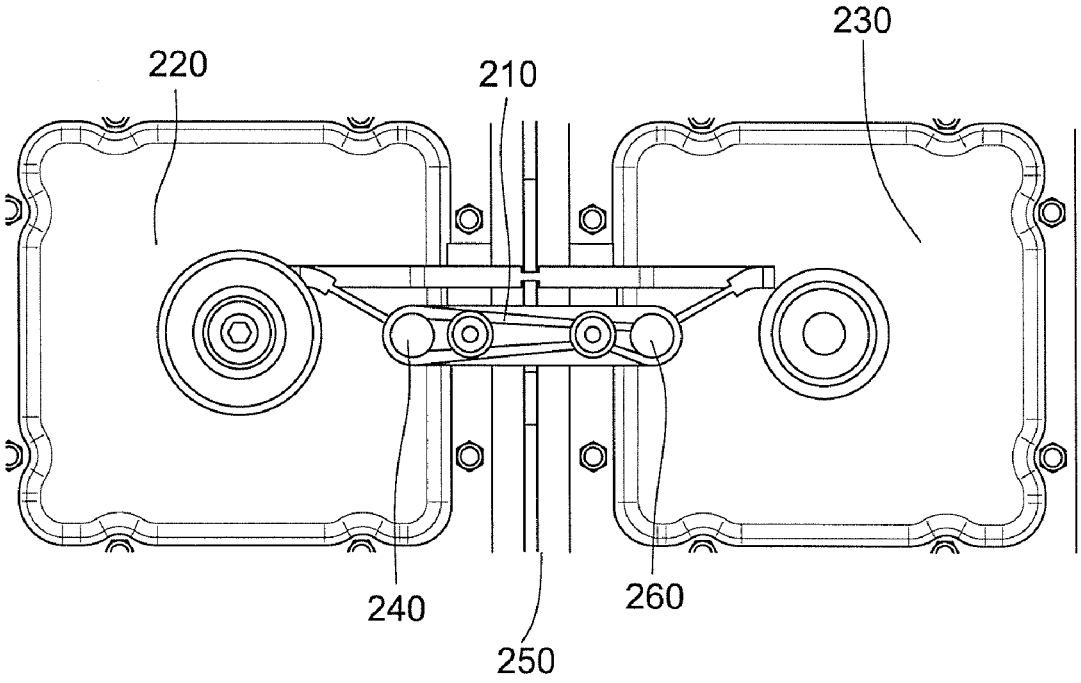
FIG. 2 is a top view of an exemplary filter element.

FIG. 2 is a top view of an exemplary filter element 200. Filter element 200 may comprise a loop wire 210, a high-band notch resonator 220, a low-band notch resonator 230, a first open slot 240, a central conductor 250, and a second open slot 260. These elements are described in detail below.

Filter element 200 may comprise a loop wire 210 made of a bendable metal such as copper. Copper may also be a good design choice for coupling element 200 because copper has an electrical conductivity of 60 mmhos/m, the second highest electrical conductivity of any element after silver. Loop wire 210 may extend from a high-band notch resonator 220 to a low-band notch resonator 230. Loop wire 210 may extend through a first open slot 240 in a cavity wall of high-band notch resonator 220 to a central conductor 250 and extend from central conductor 250 through a second open slot 260 in a cavity wall of low-band notch resonator 230.

First open slot 240 and second open slot 260 may be fabricated to be of minimal size. As will be apparent to those having ordinary skill in the art, electromagnetic waves may leak out of a cavity resonator having an aperture such as open slot. Consequently, a designer may plug first open slot 240 and second open slot 260 with respective metallic blocks to reduce leakage after loop wire 210 is inserted through both first open slot 240 and second open slot 260.

Filter element 200 may act as a tuner, combining signals from high-band notch resonator 220 and low-band notch resonator 230 to produce a filtered signal that has dual stop bands. Central conductor 250 may receive this filtered signal from both resonators 220, 230. For efficient coupling, loop wire 210 may be perpendicular to central conductor 250 to maximize energy transfer. Alternative coupling arrangements are also possible, as will apparent to those having ordinary skill in the art.

In various exemplary embodiments, central conductor 250 may be a transmission line. Alternatively, central conductor 250 may be a stripline. In a further exemplary embodiment, central conductor 250 may be a coaxial line. In yet another exemplary embodiment, central conductor 250 may be a microstrip line.

Figure 3:
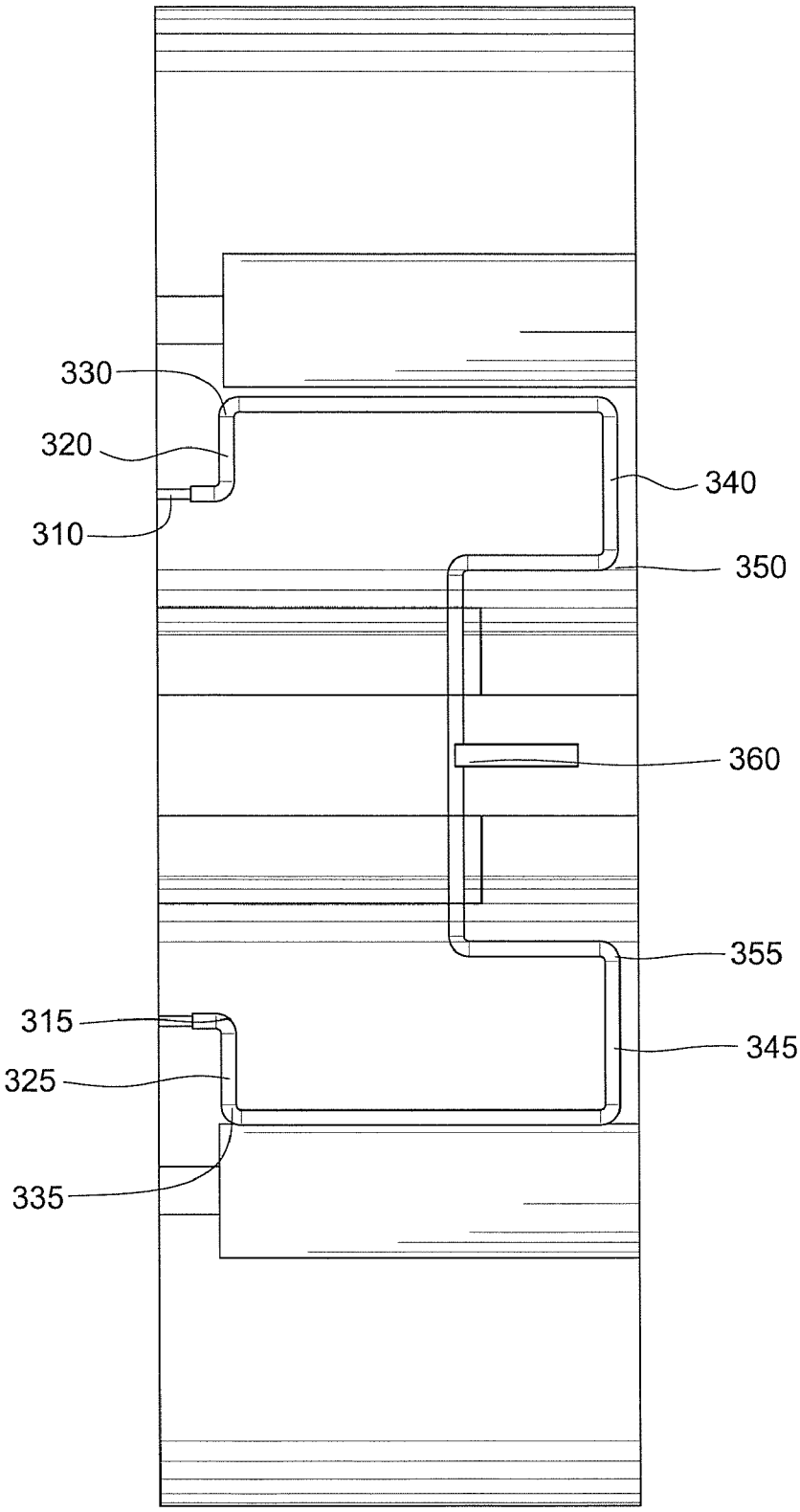
FIG. 3 is a top view of an exemplary loop wire.

FIG. 3 provides a top view of an exemplary loop wire 300, which may correspond to loop wire 210 in FIG. 2. Loop wire 300 may comprise a first end 310, a second end 315, a first bent portion 320, a second bent portion 325, a first coupling portion 330, a second coupling portion 335, a third bent portion 340, a fourth bent portion 345, a first wall portion 350, a second wall portion 355, and an energy transfer portion 360. These elements are described in detail below.

A first end 310 of the loop wire 300 may be mounted on a wall of a first cavity resonator, such as high-band resonator 110*a* depicted in FIG. 1. A second end 315 of the loop wire 300 may be mounted on a wall of a second cavity resonator, such as low-band resonator 120*a* depicted in FIG. 1. Both the first end 310 and the second end 315 of the loop wire 300 may be disposed perpendicularly to the respective walls of the cavity resonators 110*a*, 120*a*.

A first bent portion 320 of the loop wire 300 may be orthogonal to the first end 310 of the loop wire 300. Similarly, a second bent portion 325 of the loop wire 300 may be orthogonal to the second end 315 of the loop wire 300. Both the first bent portion 320 and the second bent portion 325 may be respectively directed toward central conductors of the cavity resonators 110*a*, 120*a*.

A first coupling portion 330 of the loop wire 300 may be parallel to a central conductor within high-band cavity resonator 110*a*. A second coupling portion 335 of the loop wire 300 may be parallel to a central conductor within low-band cavity resonator 120*a*. Bending loop wire 300 may alter the respective lengths of first coupling portion 330 and second coupling portion 335, thereby respectively tuning the amount of electrical energy coupled from resonators 110*a*, 120*a*. While such bending may occur in first bent portion 320 and second bent portion 325, a user may bend other portions of loop wire 300 to change the effective amount of coupling from first coupling portion 330 and second coupling portion 335, as will be apparent to those having ordinary skill in the art.

A third bent portion 340 of the loop wire 300 may be orthogonal to the first coupling portion 330 of the loop wire 300. Similarly, a fourth bent portion 345 of the loop wire 300 may be orthogonal to the second coupling portion 335 of the loop wire 300. Both the third bent portion 340 and the fourth bent portion 345 may be respectively directed away from central conductors of the cavity resonators 110*a*, 120*a*.

A first wall portion 350 of the loop wire 300 may be disposed substantially along a wall of the high-band cavity resonator 110*a*. Similarly, a second wall portion 355 of the loop wire 300 may be disposed substantially along a wall of the low-band cavity resonator 120*a*. Because first wall portion 350 and second wall portion 355 are relatively distant from the central conductors of cavity resonators 110*a*, 120*a* and located near a conductive wall, they couple an insignificant amount of energy compared to first coupling portion 330 and second portion 335. First wall portion 350 and second wall portion 355 may be respectively orthogonal to third bent portion 340 and fourth bent portion 345.

The energy transfer portion 360 of the loop wire 300 may be disposed perpendicular to a transmission line, such as central conductor 140 in FIG. 1. Energy transfer portion 360 may also be orthogonal to both first wall portion 350 and second wall portion 355. Energy transfer portion 360 may be directly soldered onto central conductor 140, using an appropriate soldering technique, as will be apparent to those having ordinary skill in the art.

The structure described for loop wire 300 above is intended to be exemplary and illustrative, not limiting in scope. As will be apparent to those having ordinary skill in the art, loop wire 300 may be fabricated with other shapes, depending upon the applicable resonator filter environment. Such shapes may be designed so that the total length of loop wire 300 is substantially an integral multiple of a quarter wavelength corresponding to a central frequency between the dual stop bands.

Figure 4:
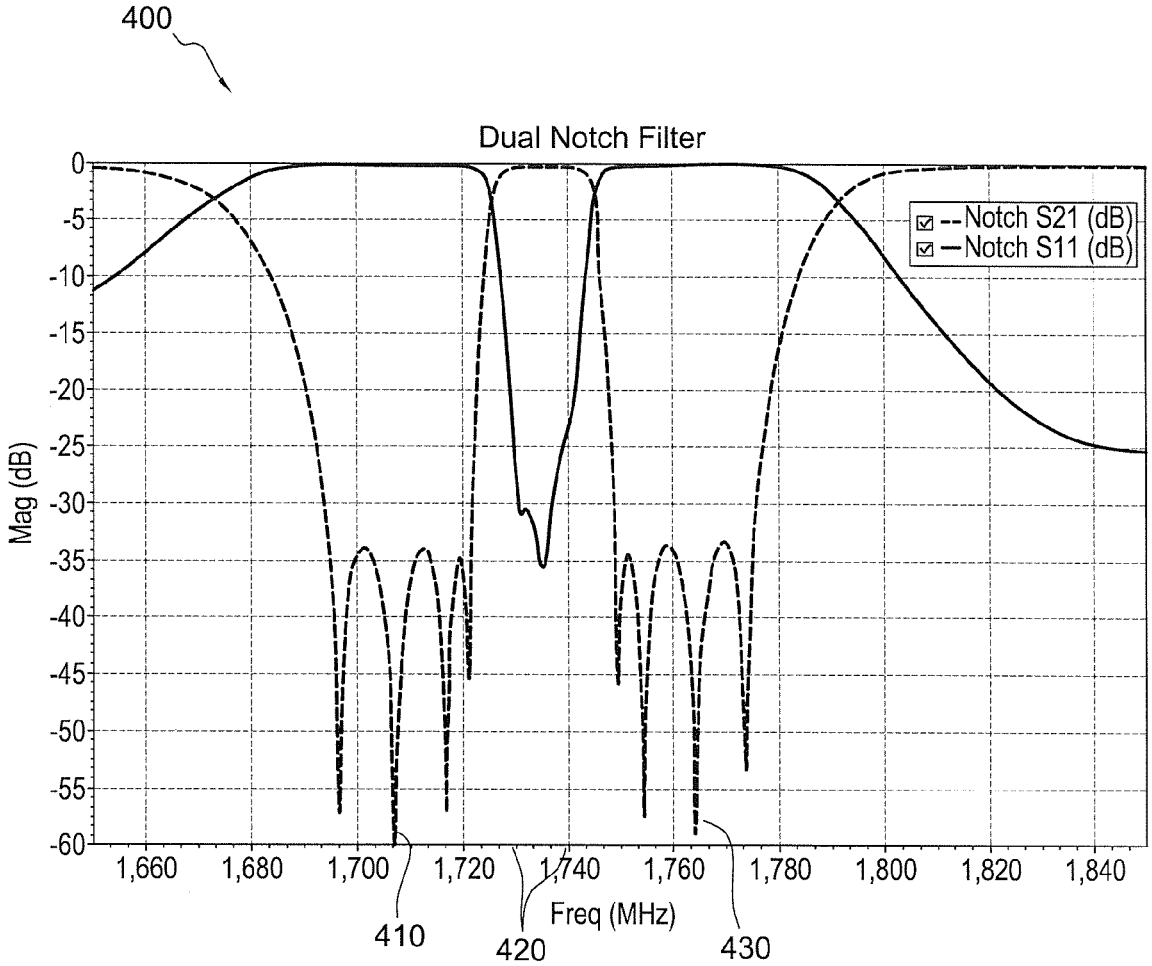
FIG. 4 is a diagram of an exemplary filter response for the tunable filter.

FIG. 4 depicts an exemplary filter response 400 for the tunable filter 100 of FIG. 1. Filter response 400 may comprise a first notch 410, a pass band 420, and a second notch 430. These elements are described in detail below.

As shown in FIG. 4, filter response 400 displays the frequency characteristics of a dual notch filter. A first notch 410 may occur in a stop band of frequencies extending from roughly 1695 MHz to 1720 MHz. A pass band 420 may occur next, defined by the 0 dB magnitude between roughly 1730 and 1740 MHz. A second notch 430 may appear on the opposite side of pass band 420 from first notch 410. Second notch 430 may encompass frequencies ranging from roughly 1750 to 1770 MHz.

First notch 410 and second notch 430 may be disposed symmetrically on either side of a central frequency within pass band 420. The central frequency within pass band 420 may be used to design the length of loop wire 300, as depicted in FIG. 3. While loop wire 300 may have a length of one quarter wavelength of the central frequency, loop wire 300 could also have a length of an integral multiple of the same quarter wavelength in order to achieve similar electrical characteristics.

As described above, frequency response 400 is intended to be exemplary and illustrative, not limiting in scope. As will be evident to those having ordinary skill in the art, first notch 410 and second notch 420 may be designed to occur at different frequency values. The widths of both first notch 410 and second notch 420 may vary to encompass broader or narrower frequency spectra, depending upon applicable resonator designs. A designer may also change the depths of both first notch 410 and second notch 420, depending upon the desired rejection level of the stop bands.

Figure 5A:
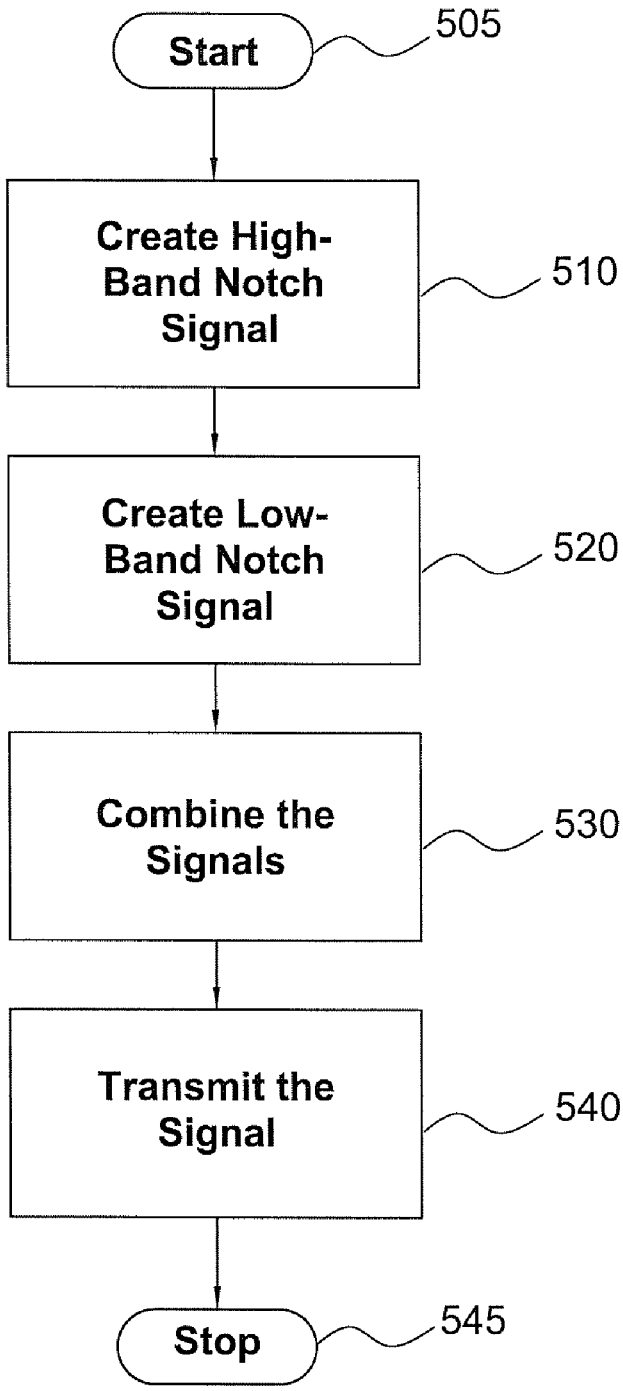
FIG. 5*a* is a flow chart of an exemplary method of tuning a signal to produce dual stop bands.

FIG. 5*a* depicts an exemplary method 500 of tuning a signal to produce dual stop bands. Method 500 starts in step 505. It then proceeds to step 510, where a plurality of high-band notch resonators 110*a*, 110*b*, 110*c*, 110*d* produce a first notch in a signal characteristic. Next, in step 520, a plurality of low-band notch resonators 120*a*, 120*b*, 120*c*, 120*d* create a second notch in the signal characteristic. The first and second notches may be symmetrically disposed on either side of a central pass band.

In step 530, at least one coupling element 130 combines signals from the high-band notch resonators 110*a*, 110*b*, 110*c*, 110*d* and low-band notch resonators 120*a*, 120*b*, 120*c*, 120*d* to produce a filtered signal that has dual stop bands. In step 540, the at least one coupling element 130 transmits this filtered signal into a central conductor 140. Such transmission may be most efficient when the coupling element 130 is soldered to be substantially perpendicular to the central conductor 140. The method stops in step 545.

Figure 5B:
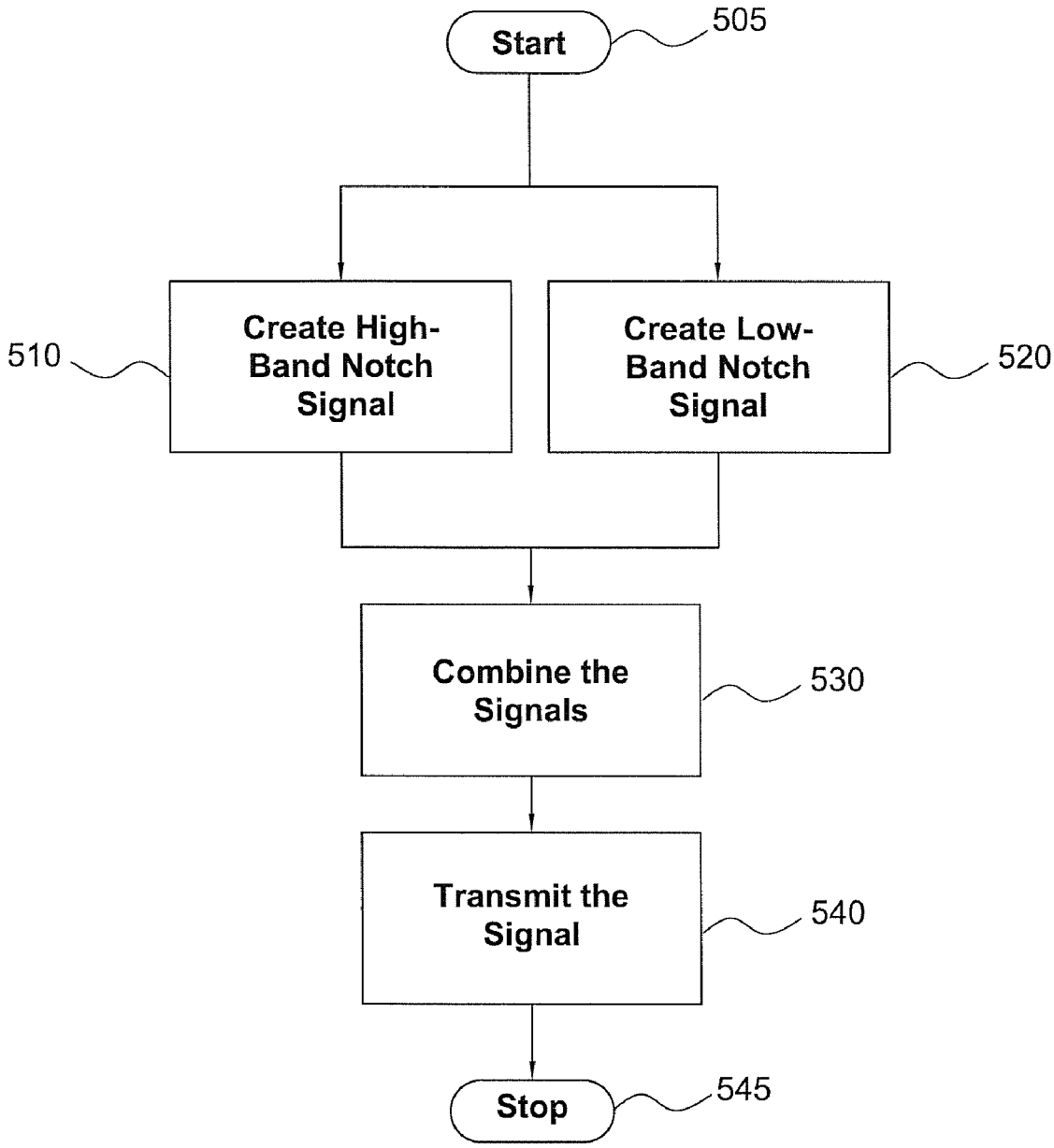
FIG. 5*b* is a flow chart of another exemplary method of tuning a signal to produce dual stop bands.

FIG. 5*b* depicts another exemplary method 550 of tuning a signal to produce dual stop bands. Exemplary method 550 resembles exemplary method 500 but uses a parallel approach instead of a serial technique. Thus, in method 550, steps 510 and 520, instead of occurring in succession, may be substantially simultaneous. Parallel production of a high-band notch and a low-band notch may result in faster operation of exemplary tunable filter 100 and simplify its operation.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications may be implemented while remaining within the spirit and scope of the invention. Accordingly, the foregoing disclosure, description, and figures are for illustrative purposes only and do not in any way limit the invention, which is defined only by the claims.

What is claimed is:

1. A tuner for a band stop filter, said tuner comprising:

a coupling element that combines signals from a high-band notch resonator and a low-band notch resonator to produce a filtered signal that has dual stop bands disposed symmetrically on either side of a central frequency; and a central conductor that receives said filtered signal from said coupling element, wherein said coupling element has a length equal to an integral multiple of a quarter wavelength of said central frequency and said coupling element is soldered to be substantially perpendicular to said central conductor.

2. The tuner of claim 1, wherein said central conductor is a transmission line.

3. The tuner of claim 1, wherein said central conductor is a stripline.

4. The tuner of claim 1, wherein said central conductor is a coaxial line.

5. The tuner of claim 1, wherein said central conductor is a microstrip line.

6. The tuner of claim 1, wherein said coupling element comprises a loop wire, said loop wire extending from said high-band notch resonator to said low-band notch resonator.

7. The tuner of claim 6, wherein said loop wire extends through a first open slot in a cavity wall of said high-band notch resonator to said central conductor and extends from said central conductor through a second open slot in a cavity wall of said low-band notch resonator.

8. A tunable filter that provides dual stop bands, said filter comprising:

a central conductor disposed along a first axis; and a plurality of filter elements that encompass said central conductor, each of said filter elements aligned along a respective axis substantially orthogonal to said first axis, each of said filter elements further comprising:

a high-band notch resonator disposed on a first side of said central conductor;

a low-band notch resonator disposed on a second side of said central conductor, said second side being substantially opposite to said first side with respect to said central conductor; and a coupling element disposed between said high-band notch resonator and said central conductor, disposed between said low-band notch resonator and said central conductor, and soldered so that at least a portion of said coupling element is substantially orthogonal to said central conductor along said respective axis of said filter element, wherein:

said coupling element combines signals from said high-band notch resonator and said low-band notch resonator to produce a filtered signal that has dual stop bands disposed symmetrically on either side of a central frequency, and said coupling element has a length substantially equal to an integral multiple of a quarter wavelength of said central frequency.

9. The filter of claim 8, wherein said central conductor is a transmission line.

10. The filter of claim 8, wherein said central conductor is a stripline.

11. The filter of claim 8, wherein said central conductor is a coaxial line.

12. The filter of claim 8, wherein said central conductor is a microstrip line.

13. The filter of claim 8, wherein said coupling element comprises a loop wire, said loop wire extending from said high-band notch resonator to said low-band notch resonator.

14. The filter of claim 13, wherein said loop wire extends through a first open slot in a cavity wall of said high-band notch resonator to said central conductor and extends from said central conductor through a second open slot in a cavity wall of said low-band notch resonator.

15. A method of tuning a signal to produce dual stop bands, said method comprising:

using a plurality of high-band notch resonators to produce a first notch in a signal characteristic;

using a plurality of low-band notch resonators to produce a second notch in said signal characteristic;

using a plurality of coupling elements to combine signals from said plurality of high-band notch resonators and said plurality of low-band notch resonators to produce a filtered signal that has dual stop bands disposed symmetrically on either side of a central frequency; and sending said filtered signal from said coupling elements to a central conductor, wherein each of said coupling elements has a length equal to an integral multiple of a quarter wavelength of said central frequency and each of said coupling elements is soldered to be substantially perpendicular to said central conductor.

16. The method of claim 15, wherein said central conductor is a transmission line.

17. The method of claim 15, wherein said central conductor is a stripline.

18. The method of claim 15, wherein said central conductor is a coaxial line.

19. The method of claim 15, wherein said central conductor is a microstrip line.

20. The method of claim 15, wherein each of said coupling elements comprises a loop wire, said loop wire extending from one of said high-band notch resonators through said central conductor to one of said low-band notch resonators.

* * * * *